US005478254A

United States Patent [19]

Holt

[11] Patent Number: 5,478,254

[45] Date of Patent: Dec. 26, 1995

[54] ELECTRICAL CONNECTOR

[75] Inventor: David G. Holt, Derby, England

[73] Assignee: Rolls-Royce, plc, London, England

[21] Appl. No.: 316,453

[22] Filed: Oct. 3, 1994

[51] Int. Cl.[6] ..... H01R 13/648

[52] U.S. Cl. ..... 439/275; 439/320; 439/610

[58] Field of Search ..... 439/98, 610, 320–323, 439/597–601, 271, 274, 275

[56] References Cited

U.S. PATENT DOCUMENTS

| | | | |
|---|---|---|---|
| 3,643,208 | 2/1972 | Massa, Jr. . | |
| 4,070,083 | 1/1978 | DiPalma . | |
| 4,243,290 | 1/1981 | Williams | 439/610 |
| 4,540,230 | 9/1985 | Iversen et al. | 439/320 |
| 4,583,809 | 4/1986 | Werth et al. | 439/610 |
| 4,804,338 | 2/1989 | Dibble et al. | 439/610 |

FOREIGN PATENT DOCUMENTS

| | | | |
|---|---|---|---|
| 2109645 | 6/1983 | United Kingdom | 439/320 |
| 2149235 | 5/1985 | United Kingdom . | |

*Primary Examiner*—Gary F. Paumen

*Attorney, Agent, or Firm*—Cushman Darby & Cushman

[57] ABSTRACT

An electrical connector has a pair of mating halves comprising a plug and a receptacle mounted on the respective ends of cables to be joined. The plug and receptacle each have a peripheral surface or shell and removable insulated inserts mounted therein through which electrical contacts extend. Spring fingers mounted on thee peripheral surfaces of the plug and receptacle retain the inserts and make electrical contact between the plug and receptacle. Bands hold the cables against the inserts to relieve the strain on the electrical contacts. Environmental seals are provided to prevent the ingress of contaminants into the connector. A releasable locking ring secures the plug and receptacle together.

8 Claims, 2 Drawing Sheets

ELECTRICAL CONNECTOR

The present invention relates to an electrical connector and in particular to an electrical connector suited to the rugged environmental requirements of aerospace applications.

A conventional electrical connector comprises mating plug and receptacle members. A plurality of socket contacts pass through an insulated insert which is adhesively bonded to the inside of the receptacle member. A plurality of pin contacts extend through an insulated insert bonded to the inside of the plug member. When the plug and receptacle are mated the pin contacts engage with the socket contacts to provide electrical contact therebetween. A threaded locking ring is provided on the receptacle member which engages with a thread on the plug member to prevent the plug and receptacle disconnecting accidentally. The locking ring has a ratchet mechanism to prevent it unscrewing if the mated connector is subjected to vibrations.

The contacts are inserted into position in the inserts through the rear of the plug and receptacle members. This means that the wires to which the contacts are attached are not screened for a short distance to enable the contacts to be subsequently removed. To prevent electromagnetic and radio interference with the signals being carried by the wires and contacts an annular shield is bolted onto the rear of the connector. A strain relief bush is also provided at the rear of the connector which engages the cable to take any loads off the wires and contacts in the connector.

The provision of both an electromagnetic shield and a strain relief bush increases the weight of the connector and increases its length making the connector more susceptible to vibration.

The connectors are also provided with seals which provide environmental protection to prevent the ingress of contaminants into the connector. However the seals and the adhesive used to bond the inserts to the insides of the plug and receptacle members give off gas when the connector is exposed to elevated temperatures. Any gases released are a hazard as they can be ignited at elevated temperatures.

A connector in accordance with the present invention seeks to eliminate the aforementioned problems and provide a lighter and shorter connector which is less susceptible to vibration and which meets the more stringent requirements of aerospace applications.

According to the present invention an electrical connector for joining cables having an at least one electrically conductive wire passing therethrough comprises a pair of mating members, the members being adapted to be mounted one respective ends of the cables to be joined, each of the members having a peripheral surface and a removable insulated insert mounted therein through which the at least one wire and an electrical contact connected to one end of the at least one wire extend, means for retaining the inserts in the members being mounted on the peripheral surfaces of the members, recesses being provided between the removable inserts and the peripheral surfaces of each of the members, means for providing cable strain relief being located in the recesses between the inserts and the peripheral surfaces of each of the members, the peripheral surfaces facing each other when the members are mated to define a further recess therebetween, a sealing element being disposed in the further recess between the peripheral surfaces to seal between the members, further sealing elements being provided to seal each of the members to the respective ends of the cables to be joined, there being further provided locking means for releasably securing the members together.

The peripheral surfaces of the members are preferably electrically conductive and shield the wires and electrical contacts from electrical interference. In the preferred embodiment of the present invention the peripheral surfaces are preferably made from titanium. Means may be provided to make electrical contact between the peripheral surfaces of the members when they are mated.

Preferably the means for retaining the inserts in the members are spring fingers which are cantilevered from the peripheral surfaces of the members. The spring fingers may also provide electrical contact between the peripheral surfaces of the members when they are mated.

The sealing element provided between the plug and receptacle is preferably an 'O' ring seal. The further sealing elements which seal each of the members to the respective end of the cables may be domed to prevent contaminants collecting thereon.

The means for providing cable strain relief is a band which passes around each of the removable insert to hold the cable against the insert so that the wires and electrical contacts do not carry any loads.

The present invention will now be described by way of example and with reference to the accompanying drawings in which.

Figure 1:
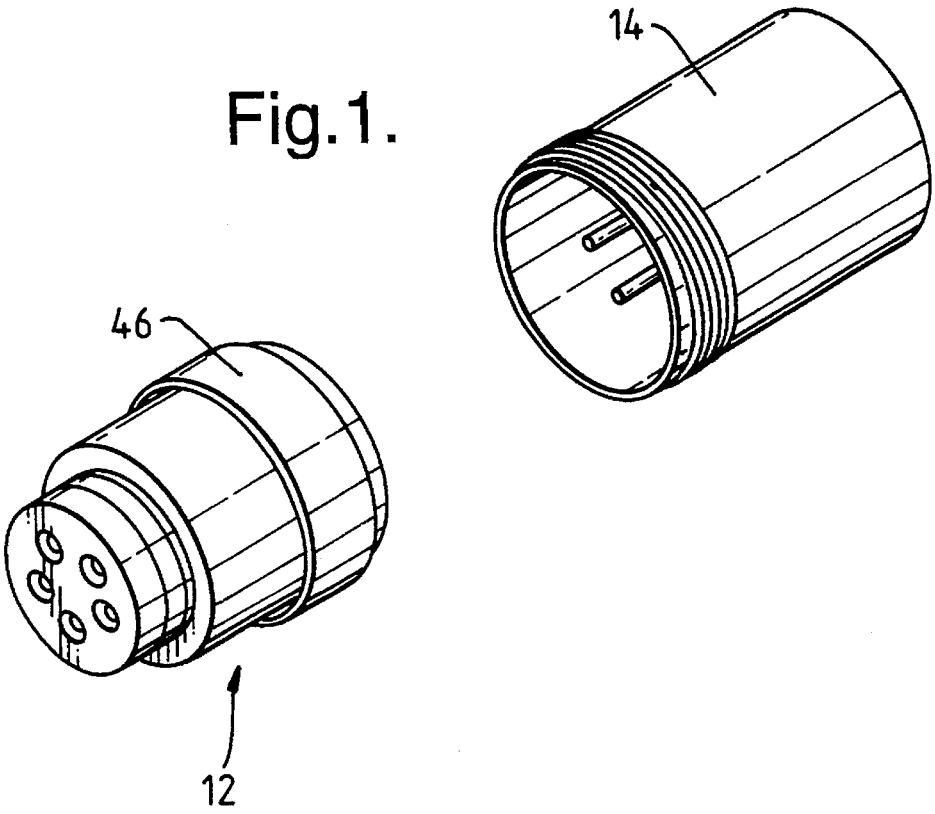
FIG. 1 is a pictorial view of a plug and receptacle of an electrical connector in accordance with the present invention.
Figure 2:
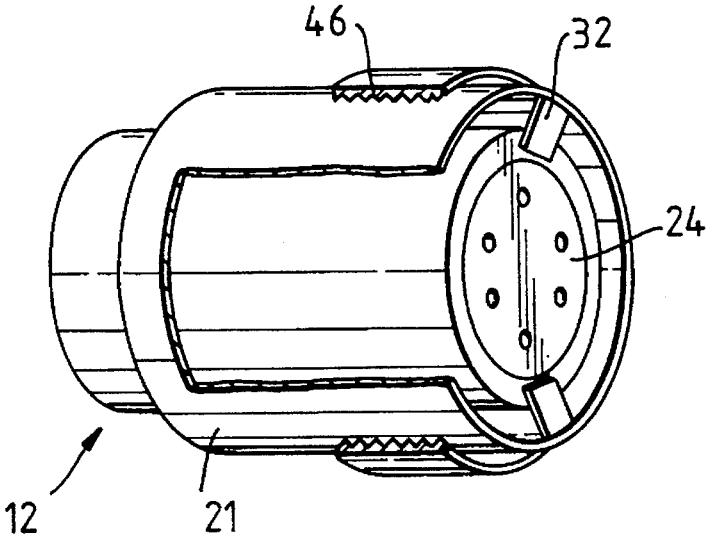
FIG. 2 is a partially broken away view of the plug shown in FIG. 1.
Figure 3:
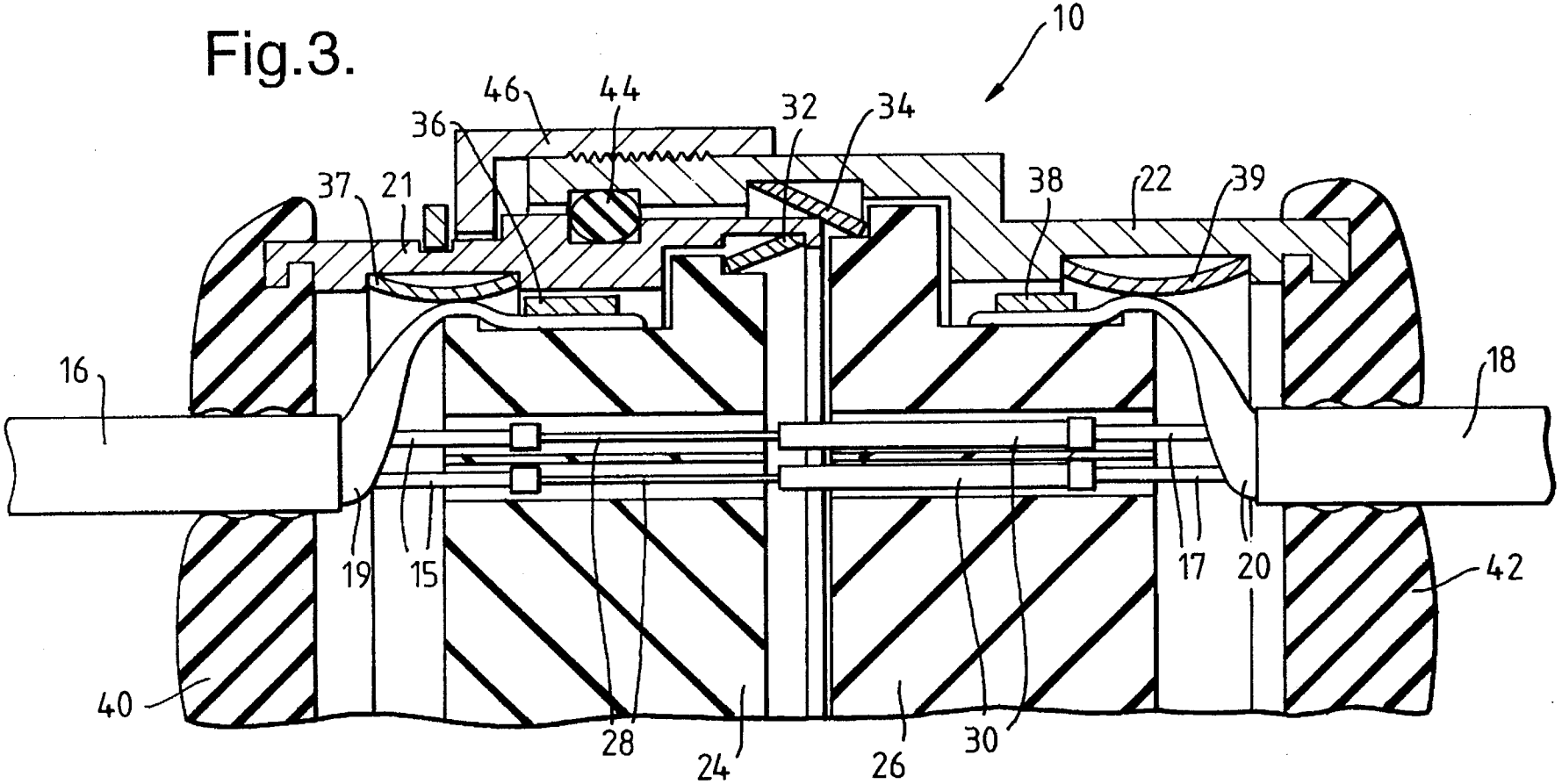
FIG. 3 is a partial longitudinal sectional view through the electrical connector shown in FIG. 1 when in its fully mated condition.

An electrical connector generally indicated at 10 has a pair of mating members which comprise a plug 12 and a receptacle 14. The plug 12 and receptacle 14 are mounted on the respective ends of cables 16 and 18 which are to be joined. Each of the cables 16 and 18 have a plurality of electrically conductive wires 15 and 17 passing therethrough. Electrical contacts 28 and 30 are attached to the ends of the wires 15 and 17 by crimping.

Each of the plug 12 and receptacle 14 has a peripheral surface or shell, 21 and 22 respectively, in which removable inserts 24 and 26 are mounted. The inserts 24 and 26 are insulators and the wires 15 and 17 and the electrical contacts 28 and 30 extend therethrough. A plurality of pin contacts 28 extend through the insert 24 in the plug 12 and a plurality of socket contacts 30 extend through the insert 26 in the receptacle 14. When the plug 12 and receptacle 14 are mated by inserting the plug 12 into the receptacle 14 the pin contacts 28 engage the socket contacts 30 to provide electrical contact between the wires 15 and 17.

The shells 21 and 22 are electrically conductive and shield the pin contacts 28 and socket contacts 30 from electromagnetic and radio frequency interference. A plurality of spring contact fingers 32 and 34 are cantilevered from the shells 21 and 22 and retain the inserts 24 and 26 in situ when the plug 12 and receptacle 14 are mated. The spring fingers 34 also provide electrical contact between the shells 21 and 22 of the plug 12 and the receptacle 14.

The inserts 24 and 26 are stepped so that the cable shields 19 and 20 can be attached to the inserts 24 and 26 by strain relief bands 36 and 38. The strain relief bands 36 and 38 ensure that any loads are taken through the cable shields 19 and 20 and not by the wires 15 and 17 or the electrical contacts 28 and 30. Further spring contact fingers 37 and 39 are provided to ground the cable shields 19 and 20.

To prevent contamination of the connector 10 a number of seals are provided. Rubber seals 40 and 42, are provided to seal each of the plug 12 and receptacle 14 to the respective cable 16 and 18. The seals 40 and 42 are domed to prevent contaminants collecting thereon and effecting the rubber. An 'O' ring seal 44 is located in an annular recess between the shells 21 and 22 of the plug 12 and receptacle 14. The 'O' ring seal 44 prevents the ingress of contaminants between the plug 12 and receptacle 14.

A threaded locking ring 46 is provided on the outer surface 23 of the shell 22 of the plug 12. The locking ring 46 engages a thread on the outer surface of the shell 22 of the receptacle 14. The locking ring 46 prevents the plug 2 and receptacle 14 from disconnecting. The locking ring 46 is provided with a ratchet mechanism (not shown) which prevents it unscrewing in the event that the connector 10 is subjected to vibrations.

The present invention provides an electrical connector 10 in which electrical shielding, contamination protection and cable strain relief are provided within the two mating halves 12 and 14. This leads to a more compact and light weight connector 10 which is less susceptible to vibration and more suitable for the rugged environments encountered in aerospace applications.

I claim:

1. An electrical connector for joining cables, each cable having an at least one electrically conductive wire passing therethrough, comprises a pair of mating members, the members being adapted to be mounted on respective ends of the cables to be joined, each of the members having a peripheral surface and a removable insulated insert mounted therein through which the at least one wire and an electrical contact connected to one end of the at least one wire extend, means for retaining the inserts in the members being mounted on the peripheral surfaces of the members, recesses being provided between the removable inserts and the peripheral surfaces of each of the members, means for providing cable strain relief being located in the recesses between the insert and the peripheral surface of each of the members, the peripheral surfaces facing each other when the members are mated to define a further recess therebetween, a sealing element being disposed in the further recess between the peripheral surfaces to seal between the members, further sealing elements being provided to seal each of the members to the respective ends of the cables to be joined, there being further provided locking means for releasably securing the members together.

2. An electrical connector as claimed in claim 1 in which the means for providing cable strain relief is a band which passes around each of the removable insert to hold the cable against the insert.

3. An electrical connector as claimed in claim 1 in which the peripheral surfaces of the members are electrically conductive.

4. An electrical connector as claimed in claim 3 in which means are provided to make electrical contact between the peripheral surfaces of the members when they are mated.

5. An electrical connector as claimed in claim 1 in which the means for retaining the inserts in the members are spring fingers which are cantilevered from the peripheral surfaces of the members.

6. An electrical connector as claimed in claim 5 in which the spring fingers on one of the members provide electrical contact between the peripheral surfaces of the members when they are mated.

7. An electrical connector as claimed in claim 1 in which the sealing element disposed in the recess between the peripheral surfaces of the members is an 'O' ring seal.

8. An electrical connector as claimed in claim 1 in which the further sealing elements which seal each of the members to the respective end of the cables to be joined are domed to prevent contaminants from collecting thereon.

* * * * *